United States Patent [19]

Guerrazzi et al.

[11] 4,412,633

[45] Nov. 1, 1983

[54] VENTED SYNTHETIC-RESIN JUG

[75] Inventors: Vincent Guerrazzi, Nanterre; Valerio Vendramini, Maubeuge, both of France

[73] Assignee: Seprosy Societe Europeenne pour la Transformation des Produits de Synthese, Paris, France

[21] Appl. No.: 349,172

[22] Filed: Feb. 16, 1982

[30] Foreign Application Priority Data

Feb. 17, 1981 [FR] France ..... 81 03482
May 26, 1981 [FR] France ..... 81 10835

[51] Int. Cl.[3] ..... B65D 23/10
[52] U.S. Cl. ..... 222/468
[58] Field of Search ..... 222/468, 475; 215/1 C

[56] References Cited

U.S. PATENT DOCUMENTS 3,251,514 5/1966 Speicher ..... 222/468
3,308,997 3/1967 Kelly ..... 215/1 C UX
3,434,635 3/1969 Mason ..... 222/468
4,030,664 6/1977 Tisbo et al. ..... 222/468 X

*Primary Examiner*—Donald F. Norton
*Attorney, Agent, or Firm*—Karl F. Ross

[57] ABSTRACT

A jug comprises a hollow body shaped to contain a liquid and having a bottom, a top wall, and opposite front and rear walls extending between the bottom and top wall and a collar formed in and projecting upwardly from the top wall adjacent the front wall and defining a pour mouth so that a closure can be engaged sealingly with the collar. The jug is provided with a tubular handle having a rear end opening into the body and connected to the top wall adjacent the rear wall and a front end connected to the top wall spacedly adjacent the collar. In addition structure is provided which is unitary with the handle and top wall and which forms a passage extending from the front end of the handle to the collar in the mouth. Thus, when the jug is forwardly tipped to pour liquid from the mouth, air can enter the body through the passage and tubular handle.

9 Claims, 5 Drawing Figures

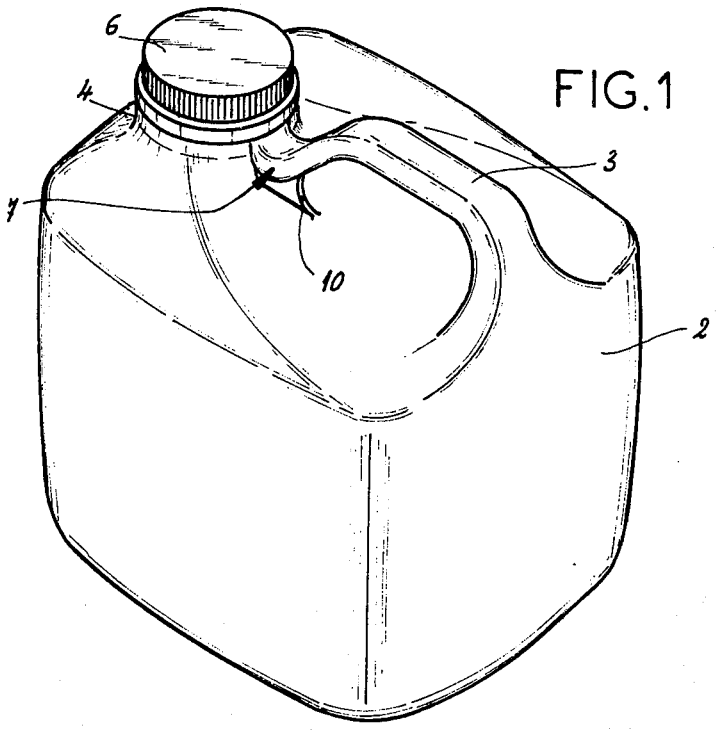
FIG. 1
FIG. 2
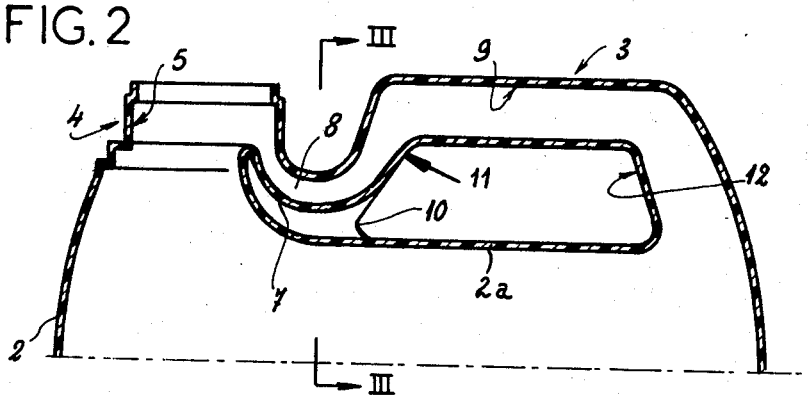
FIG. 3
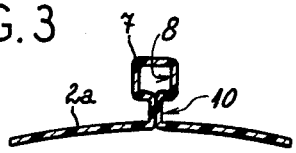

VENTED SYNTHETIC-RESIN JUG

FIELD OF THE INVENTION

The present invention relates to a jug. More particularly this invention concerns such a jug provided with a pouring vent.

BACKGROUND OF THE INVENTION

A standard jug has a hollow body shaped to contain a liquid and having a bottom, a top wall, and opposite front and rear walls extending between the bottom and top wall. A collar is formed in and projects upwardly from the top wall adjacent the front wall. This collar defines a pour mouth with which a closure, normally a screw cap, can be sealingly engaged to block this mouth. Some sort of handle is normally provided on the top wall, preferably one that does not project vertically upwardly beyond the plane of the top of the cap so that the jugs can be stacked.

As the jug is tipped forwardly the mouth will normally be lowered below the liquid level in the jug, tapping the air in the jug above the liquid. If no vent is provided to admit air to this region, flow of liquid out of the jug will alternate with flow of air into the jug. Obviously such action means the poured stream is difficult to control so that the user risks making a mess with the liquid. When the liquid is toxic or flammable this can be quite dangerous.

Accordingly it is known to provide a vent on the top wall of the jug adjacent its rear wall. In the simplest plastic jugs a hollow bump is formed that can be broken off to form a vent hole in the top wall. Such an arrangement has the considerable disadvantage that it makes reuse of the jug impossible, and in fact is only used on jugs whose contents are all used at one time, since the vent opening cannot be closed after it has been opened.

Another solution lies in forming a small threaded vent collar on the top wall adjacent the rear wall, and providing a separate screwdown vent cap that can be loosened to permit air to enter the jug. Providing this separate element, the vent cap, and forming the separate threaded opening increases fabrication costs of the jug. In addition it is common for the user to forget to open the vent, exposing himself or herself to the hazards of sloppy pouring mentioned above.

It is possible to provide with a given size jug a vent device that fits over the collar and that has a tube that extends, when it is fitted to the jug, up inside the jug to a location adjacent the rear wall. Thus once this accessory is fitted to the pour mouth air can enter via the tube. Obviously such an accessory is not convenient to use, is liable to get lost, and adds to the cost of the jug.

Finally it has been suggested to combine the handle formation with a vent arrangement. To this end the handle is tubular and has a rear end opening into the body of the jug adjacent its rear wall, and a front end that extends horizontally to the collar where it opens into this collar at the pour mouth. Such an arrangement works quite well for pouring, as air can enter at the uncovered pour mouth into the front handle tube end and pass through the handle to the interior of the jug. The considerable problem with such an arrangement is that the collar must project up above the handle, and the handle structure considerably weakens the jug. Thus stacking such jugs atop one another is impossible.

OBJECTS OF THE INVENTION

It is therefore an object of the present invention to provide an improved vented jug.

Another object is the provision of such a vented jug which overcomes the above-given disadvantages.

A further object is to provide a reusable vented jug which can be produced at low cost, yet which is easy to use and can be stacked.

SUMMARY OF THE INVENTION

These objects are attained according to the instant invention in a jug of the above-described general type, that is comprising a hollow body shaped to contain a liquid and having a bottom, a top wall, and opposite front and rear walls extending between the bottom and top wall and a collar formed in and projecting upwardly from the top wall adjacent the front wall and defining a pour mouth so that a closure can be engaged sealingly with the collar. The jug according to the instant invention is provided with a tubular handle having a rear end opening into the body and connected to the top wall adjacent the rear wall and a front end connected to the top wall spacedly adjacent the collar. In addition according to the invention structure is provided which is unitary with the handle and top wall and which forms a passage extending from the front end of the handle to the collar in the mouth. Thus, when the jug is forwardly tipped to pour liquid from the mouth, air can enter the body through the passage and tubular handle.

Such a jug looks like a standard unvented jug, but has in fact an effective and automatic vent. In addition such a jug can be produced by blow molding as cheaply as a prior-art unvented jug. Thus according to the instant invention the jug is substantially symmetrical about a plane bisecting the collar, handle, passage, and front and rear walls. This plane is the closing plane of the mold that forms the jug, which needs no subsequent formation operations, such as drilling out the vent passage, once it has been molded. The handle, body, and structure are unitary and are normally made of an appropriate moldable synthetic resin.

Another advantage of the system according to this invention is that the handle can easily be constructed so its upper edge lies on a horizontal plane lying on the top surface of the cap. In this manner the handle and cap form a level support surface. In addition since the handle stands at its front end on the top wall and is not supported on the collar, this handle is quite strong so that the jugs according to this invention can be stacked several high.

According to another feature of this invention the passage is U-shaped and upwardly concave. In order to prevent uneven pouring when, because the jug has been tipped over or refilled, some liquid is trapped in this elbow passage, the structure forms an upright passage branch extending between the lowest portion of the passage and the body. Liquid trapped in the passage can drain through this branch into the body. To prevent the passage from filling up during pouring through this branch, it is of substantially smaller flow cross section than the passage. Thus the greater pressure of the air flowing into the jug will prevent any liquid flow along the branch into the passage.

According to another feature of the invention a substantially flat web lying on the plane is connected to and extends between the structure and the top wall. The above-described branch can be formed in this web.

Even if no such web is provided, the web greatly reinforces the handle, and can be easily produced when the jug is blow molded, normally from a durable and cheap synthetis resin such as polyethylene.

The passage according to this invention opens upwardly in the collar. Thus air flow into the jug through this passage will inherently take place and be extremely smooth, as the liquid flow past it in the opposite direction will in no way block off this outer passage end. The user need not make any supplementary motions to have the vent work, so that the system of this invention is foolproof.

DESCRIPTION OF THE DRAWING

The above and other features and advantages will become more readily apparent from the following, reference being made to the accompanying drawing in which:

FIG. 1 is a perspective view of a jug according to this invention;

FIG. 2 is a vertical section through the jug of FIG. 1;

FIG. 3 is a section taken along line III—III of FIG. 2;

SPECIFIC DESCRIPTION

Figure 4:
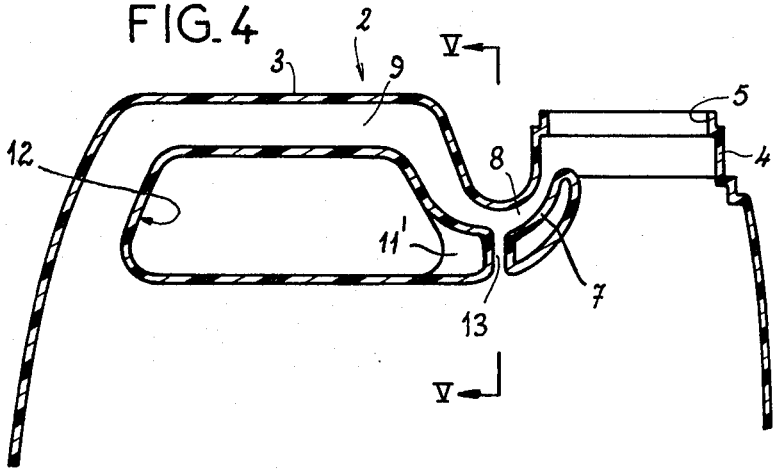
FIG. 4 is a section similar to that of FIG. 2 but showing another jug according to the present invention.

As seen in FIGS. 1-3 a jug according to this invention has a standard vessel body 2 whose bottom is flat and whose top wall 2*a* is formed with a handle 3 and with a collar 4 that defines an upwardly open pour mouth 5 and that is normally covered by an internally threaded cap 6 of standard design.

The handle 3 is tubular and has a rear end 12 joined to and opening downwardly into the jug body 2 and a front end 11 that is spaced from the collar 4 and that opens downwardly into the rear end of a U-shaped tube 7 having a front end joined to the mouth 5. This tube 7 defines a passage 8 that communicates with the passage 9 formed by the handle 3. Thus when the jug is tipped forwardly, that is with the collar 4 down and the rear handle end 12 up, liquid flows unimpeded out of the open collar 4 and air can similarly enter the body 2 via the passages 8 and 9.

The jug according to this invention is symmetrical about a center plane that is the section plane of FIG. 2. It can therefore be produced at low cost by blow molding. In order to reinforce the jug, a stiff web 10 is formed between the lower wall of the tube 7 and the top wall 2*a*. Since the handle 2 stops short of the collar 4, and is joined to the top wall 2*a* by mainly upright ends 11 and 12, this handle is quite strong. In addition the top edge of the handle 2 is level with the top surface of the cap 6 when same is screwed down, so that such jugs can be stacked atop one other.

Figure 5:
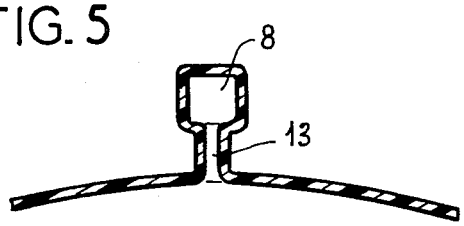
FIG. 5 is a section taken along line V—V of FIG. 4.

FIGS. 4 and 5 show a substantially identical arrangement, but here the web 11' is not completely closed, forming an upright small-diameter passage 13 extending from the lowest portion of the U-passage 8 to the interior of the jug body 2. Any liquid that becomes trapped in this passage 8 during refilling or when the jug is tipped when closed can drain via the passage branch 13 from this passage 8 as the jug stands. Thus there will not even be a temporary blockage of the passage 8 at the start of pouring when the passage 8 has somehow trapped a quantity of liquid. In order to prevent the passage 8 from filling up through this passage during pouring, the flow cross-section of the passage branch 13 is substantially smaller than that of the passage 8. Thus pressure in the passage 8 will be higher than the pressure urging the liquid into the lower end of the branch 13.

The vented container according to this invention therefore functions automatically. The user need merely uncap the jug and pour, and will be assured of smooth pouring due to the vent. The jug can nonetheless be produced at the same cost as unvented jugs, and is as convenient to use, store, and ship.

We claim:

1. A jug comprising:

a hollow body shaped to contain a liquid and having a bottom, a top wall, and opposite front and rear walls extending between said bottom and top walls;

a collar formed in and projecting upward from said top wall adjacent said front wall and defining an upwardly open pour mouth, whereby a closure can be engaged sealingly with said collar;

a tubular handle having a rear end opening into said body and connected to said top wall adjacent said rear wall and a front end connected to said top wall spacedly adjacent said collar; and structure unitary with said handle and top wall forming a passage extending from said front end of said handle and opening upward directly into said collar in said mouth, whereby when said jug is forwardly tipped to pour liquid from said mouth, air can enter said body through said passage and tubular handle.

2. The jug defined in claim 1 wherein said jug is substantially symmetrical about a plane bisecting said collar, handle, passage, and front and rear walls.

3. The jug defined in claim 2 wherein said handle, body, and structure are unitary.

4. The jug defined in claim 3 wherein said passage is U-shaped and upwardly concave.

5. The jug defined in claim 4 wherein said collar is externally threaded and said closure is an internally threaded cap.

6. A jug comprising:

a hollow body shaped to contain a liquid and having a bottom, a top wall, and opposite front and rear walls extending between said bottom and top walls;

a collar formed in and projecting upward from said top wall adjacent said front wall and defining a pour mouth, whereby a closure can be engaged sealingly with said collar;

a tubular handle having a rear end opening into said body and connected to said top wall adjacent said rear wall and a front end connected to said top wall spacedly adjacent said collar; and structure unitary with said handle and top wall forming a U-shaped and upwardly concave passage extending from said front end of said handle to said collar in said mouth, whereby when said jug is tipped forward to pour liquid from said mouth, air can enter said body through said passage and tubular handle, said jug being unitary and substantially symmetrical about a plane bisecting said collar, handle, passage, and front and rear walls, said structure forms an upright passage branch extending between the lowest portion of said passage and said body, whereby liquid trapped in said passage can drain through said branch into said body.

7. The jug defined in claim 6 wherein said branch is of substantially smaller flow cross section than said passage.

8. The jug defined in claim 7, further comprising a substantially flat web lying on said plane and connected to and extending between said structure and said top wall, said branch being formed in said web.

9. A jug comprising:

a hollow body shaped to contain a liquid and having a bottom, a top wall, and opposite front and rear walls extending between said bottom and top walls;

a collar formed in and projecting upward from said top wall adjacent said front wall and defining a pour mouth, whereby a closure can be engaged sealingly with said collar;

a tubular handle having a rear end opening into said body and connected to said top wall adjacent said rear wall and a front end connected to said top wall spacedly adjacent said collar;

structure unitary with said handle and top wall forming a U-shaped and upwardly concave passage extending from said front end of said handle to said collar in said mouth, whereby when said jug is tipped forward to pour liquid from said mouth, air can enter said body through said passage and tubular handle, said jug being unitary and substantially symmetrical about a plane bisecting said collar, handle, passage, and front and rear walls; and a substantially flat web lying on said plane and connected to and extending between said structure and said top wall.

* * * * *